US011666794B2

(12) United States Patent
Chambers et al.

(10) Patent No.: US 11,666,794 B2
(45) Date of Patent: Jun. 6, 2023

(54) WEIGHT TRAINING VEST

(71) Applicant: 5.11, Inc., Irvine, CA (US)

(72) Inventors: Justin Chambers, Costa Mesa, CA (US); Sharon Park, Irvine, CA (US); Alan Vespe, Long Beach, CA (US)

(73) Assignee: 5.11, INC., Irvine, CA (US)

( * ) Notice: Subject to any disclaimer, the term of this patent is extended or adjusted under 35 U.S.C. 154(b) by 0 days.

(21) Appl. No.: 17/372,258

(22) Filed: Jul. 9, 2021

(65) Prior Publication Data

US 2023/0011221 A1 Jan. 12, 2023

(51) Int. Cl.
*A63B 21/065* (2006.01)
*A63B 21/00* (2006.01)

(52) U.S. Cl.
CPC ..... *A63B 21/065* (2013.01); *A63B 21/4007* (2015.10)

(58) Field of Classification Search
CPC ..... A63B 21/065; A63B 21/4007; A63B 21/4009; A63B 21/4025; A41D 13/0012; A41D 27/205; A41D 27/201; A41D 27/202; A41D 27/204; A41D 27/208
See application file for complete search history.

(56) References Cited

U.S. PATENT DOCUMENTS 4,658,442 A * 4/1987 Tomlinson ..... A63B 21/065 2/2.5
6,834,396 B2 * 12/2004 Franco-Sion ..... A63B 21/065 2/102
7,490,361 B1 * 2/2009 Floyd ..... A63B 21/4005 2/94
8,262,545 B1 * 9/2012 Beber ..... A63B 21/065 224/264
9,664,481 B2 * 5/2017 Alcantra ..... A41D 1/04
10,455,869 B1 * 10/2019 Dille ..... F41H 1/02
2016/0138894 A1 * 5/2016 Heise ..... F41H 5/0457 89/36.05
2017/0127731 A1 * 5/2017 Flower ..... A41C 3/0057
2019/0041167 A1 * 2/2019 Swan ..... A45F 3/14
2020/0323280 A1 * 10/2020 Smith ..... A41C 3/12
2021/0310770 A1 * 10/2021 Beck ..... F41H 5/0485

OTHER PUBLICATIONS

U.S. Appl. No. 29/798,795, "Weight Training Vest," filed Jul. 9, 2021, 6 pages.

* cited by examiner

*Primary Examiner* — Joshua Lee
(74) *Attorney, Agent, or Firm* — Kilpatrick Townsend & Stockton LLP

(57) ABSTRACT

A weight-training vest assembly may include front and rear panels for receiving weighted inserts. First and second lateral cummerbund segments may connect the front and rear panels along a wearer's torso sides and respectively include a zippered pocket and/or a lapped-band pocket. The zippered pocket may include a zipper operable to block or unblock an aperture that permits access into an internal volume from outside the zippered pocket. The lapped-band pocket may include a lower rim of a cover substrate lapped over an upper rim of a base substrate to define a fastener-less passage into an interior volume of the lapped-band pocket. Stretch woven fabric or other stretchable material may form the pockets, e.g., to maintain snugness despite user athletic training movements and/or to maintain the rims in overlapping engagement to retain items within the lapped-band pocket.

20 Claims, 4 Drawing Sheets

WEIGHT TRAINING VEST

BACKGROUND

Plate carriers and weight-training vests are two different categories of gear. Items in these categories can share some similarities, yet also may be subject to important distinctions.

Often, plate carriers have a form factor of a vest, for example, including shoulder yokes that rest on a wearer's shoulders and support respective front and back panels that each include pockets for receiving plates. Such a plate is typically a generally rigid body (e.g., with an overall shape that is flat or at least partially curved) and may include ballistic material or non-ballistic material, depending on the context of use for the plate carrier.

For example, for military, law enforcement, or other tactical contexts, a ballistic plate may be inserted and retained within a pocket in a plate carrier to provide protection for the wearer against injury from bullets or other projectiles. The pocket may allow for different sizes of plates, for example. Many plate carriers feature length-adjustable straps to secure different size plates such as large, medium, or small. This may allow for flexibility for a user to select between different plate sizes (e.g., among different footprints and/or thicknesses), such as to customize the plate used for a particular situation and trade-off between weight and level of ballistic protection.

Plate carriers are sometimes also used for athletic training purposes. For example, plate carriers have become increasingly common for people participating in cross-training, weightlifting, or other physical exertion exercises. In such contexts, users will often substitute different weights of non-ballistic weighted plates within the plate carrier for customizing a difficulty or intensity of a work-out.

At the same time, plate carriers are designed with features suitable for high threat level situations and for protecting the safety of the operator. These features are often unnecessary for athletic training purposes. Among other features, plate carriers may include emergency drag handles, attachment platforms for mounting and/or securing gear (e.g., which may implement features compatible with relevant interfaces of Pouch Attachment Ladder System (PALS), Modular Lightweight Load-carrying Equipment (MOLLE), or other systems), and/or quick release systems (e.g., which may allow a user to pull a handle or operate some other manipulandum to separate some part of the plate carrier so the user can be less encumbered, such as in situations where quick escape may be more important than continued ballistic protection). However, these or other tactically-relevant features may be superfluous and/or cumbersome in athletic training situations, e.g., based on added weight, bulk, and/or complexity that may be contributed by such tactically-relevant features.

Weight-training vests may have similar form factors to plate carriers, such as including shoulder yokes and front and back panels with plate-receiving pockets. However, weight-training vests may be designed to be limited to use in athletic training situations. For example, compared with plate carriers, weight-training vests in some regards may be more simplified (e.g., when provided without certain tactically-relevant features). Additionally or alternatively, compared with plate carriers, weight-training vests in some regards may be more complex (e.g., when including other features that may be incongruous or not particularly well suited for tactical situations).

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein can relate to weight-training vests and/or related features, e.g., which may include features that may be better suited for athletic training situations than tactical situations. In an illustrative example, a weight-training vest assembly may include front and rear panels for receiving weighted inserts. First and second lateral cummerbund segments may connect the front and rear panels along a wearer's torso sides and respectively include a zippered pocket and/or a lapped-band pocket.

The zippered pocket may include a zipper operable to block or unblock an aperture that permits access into an internal volume from outside the zippered pocket. The zipper may be particularly suited for athletic training situations (e.g., providing a secure closure for enclosing or encapsulating a pocket interior that may hold snacks, headphones, keys, or other nebulous or discrete items that may be readily accessed by operating the zipper at ease between reps or before or after a workout). The zipper may be better suited for athletic training situations in comparison to tactical situations (e.g., where zippers may be prone to jam due to exposure to sand or other environmental factors, where access to pocket contents may need to be faster than potentially-jammed zippers may afford, where space may be insufficient on account of side cummerbund potentially being occupied by attachment capability such as MOLLE or multiple storage pouches to accommodate specific gear needed for tactical operations such as a magazine, radio, etc., and/or where zippers may risk snagging or otherwise interfering with straps or other features of rucksacks, weapons, or other gear that may be present in a tactical scenario but unlikely to be present in an athletic-training scenario).

The lapped-band pocket may include outward-facing top and bottom substrates or bands that overlap along adjacent upper and lower rims. The lapped rims may define a fastener-less passage into an interior volume of the lapped-band pocket. For example, the passage may be arranged so that a user may reach a hand initially between the rims (e.g., behind the upper rim and in front of the lower rim), then up and over the lower rim (while still behind the upper rim), and finally behind and below both the lower rim and the upper rim to gain access to items in the interior of the pocket. Such a lapped-band pocket may be suitable for athletic training where ready access may be desirable for a towel or other item in a quick access manner before, after, or during a workout, and where there is minimal risk of important gear falling out as may be a concern in a tactical situation.

Stretch woven fabric or other stretchable material may form the pockets or other portion of the cummerbund. For example, stretchability may maintain a snug and flexible fit around the wearer's torso in athletic training situations and/or may maintain the rims in overlapping engagement to retain items within the lapped-band pocket.

For a fuller understanding of the nature and advantages of the present invention, reference should be made to the ensuing detailed description and accompanying drawings.

Other aspects, objects and advantages of the invention will be apparent from the drawings and the detailed description that follows.

BRIEF DESCRIPTION OF THE DRAWINGS

Various embodiments in accordance with the present disclosure will be described with reference to the drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
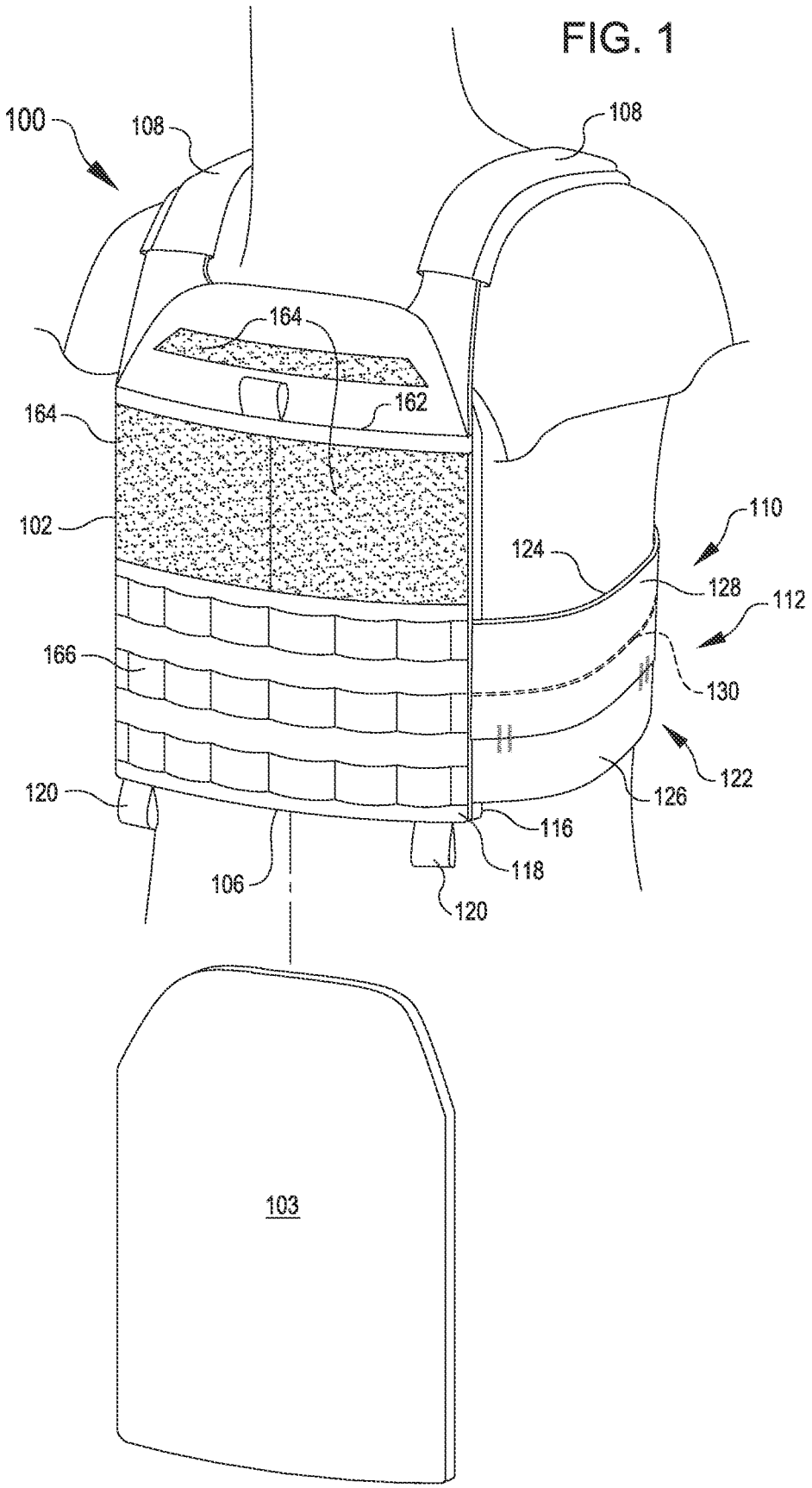
FIG. 1 shows a first front perspective view of a weight-training vest according to some embodiments.
Figure 2:
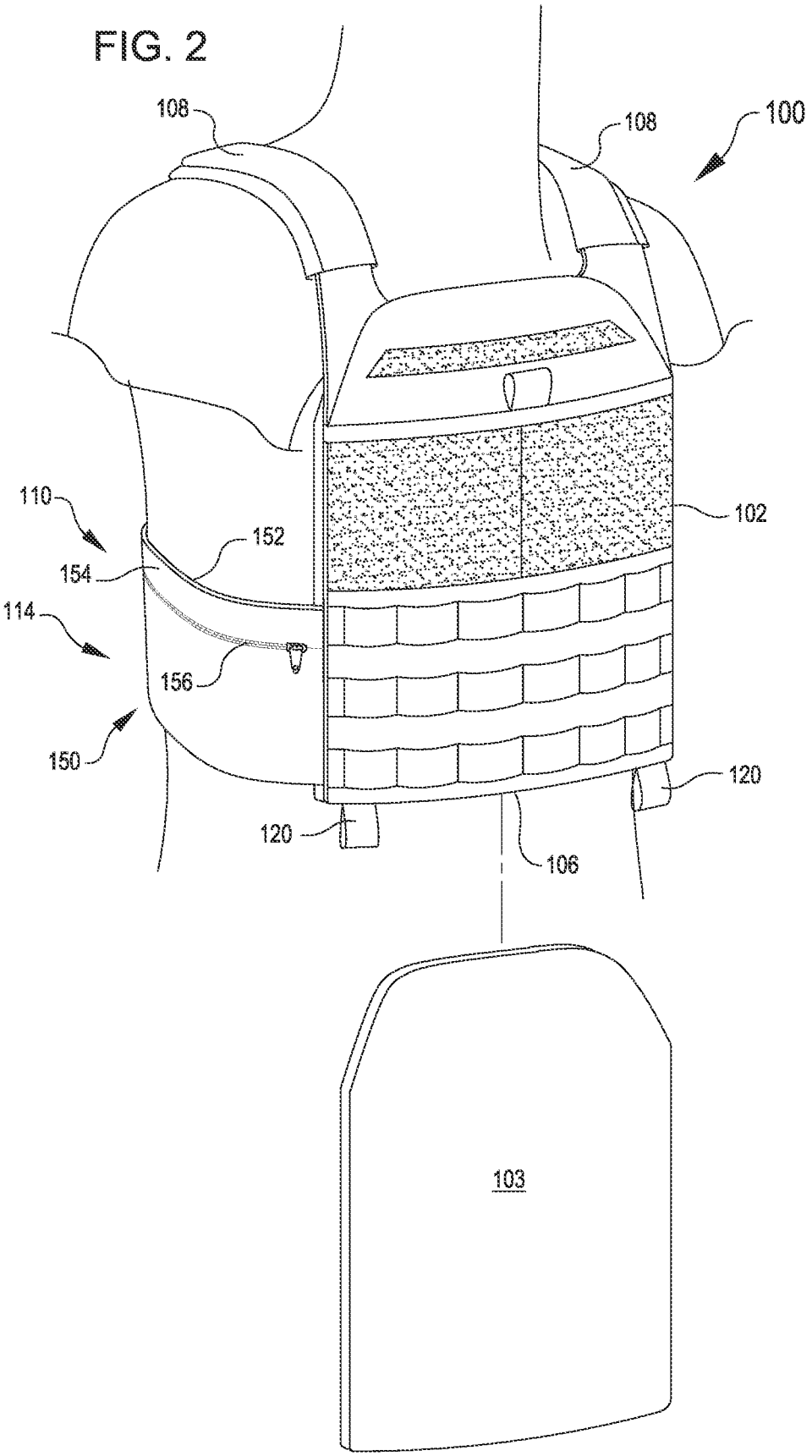
FIG. 2 shows a second front perspective view of a weight-training vest according to some embodiments.
Figure 3:
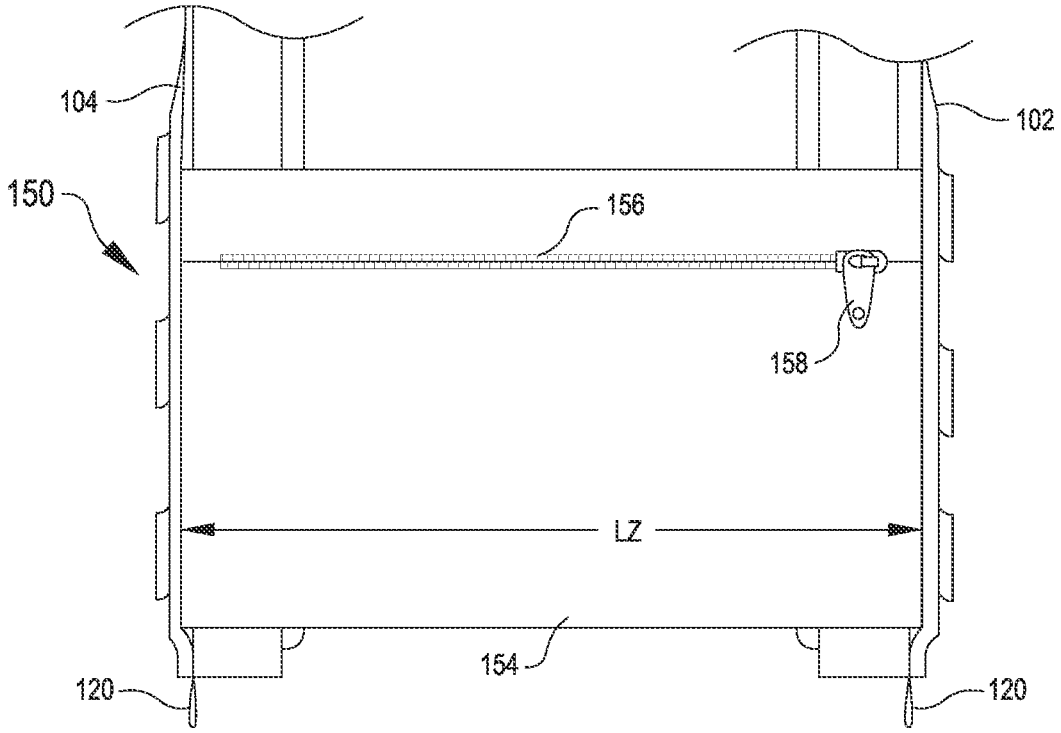
FIG. 3 shows a side detail view of a portion of a weight-training vest and an associated zippered pocket according to some embodiments.
Figure 4:
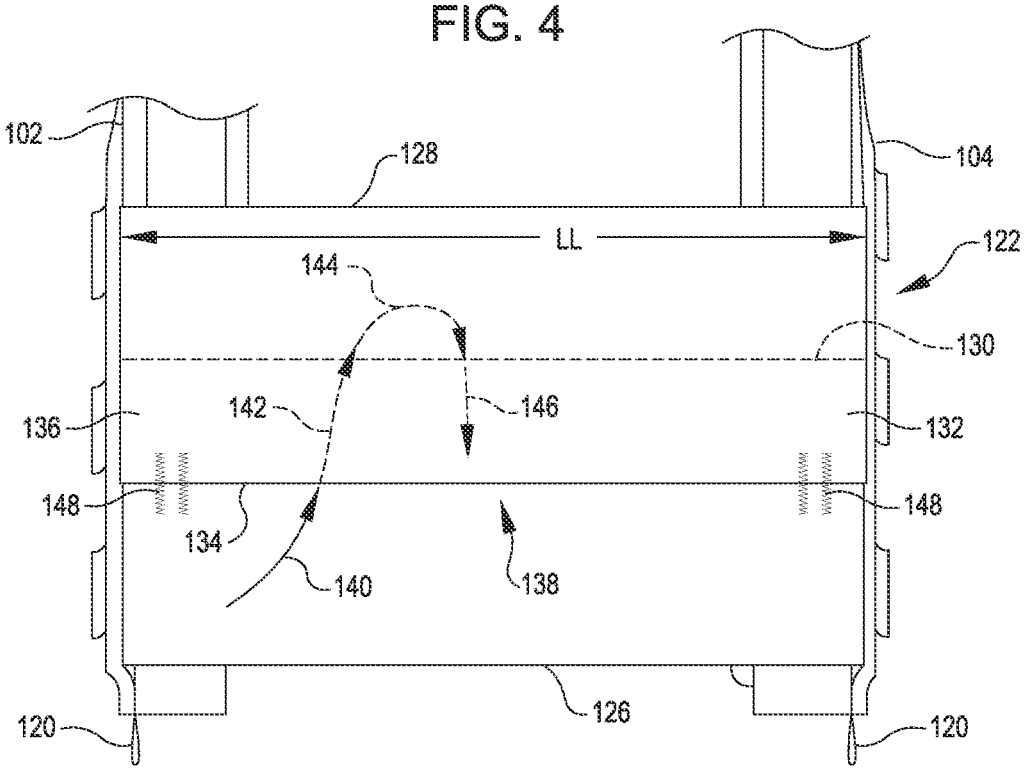
FIG. 4 shows a side detail view of a portion of a weight-training vest and an associated lapped-band pocket according to some embodiments.
Figure 5:
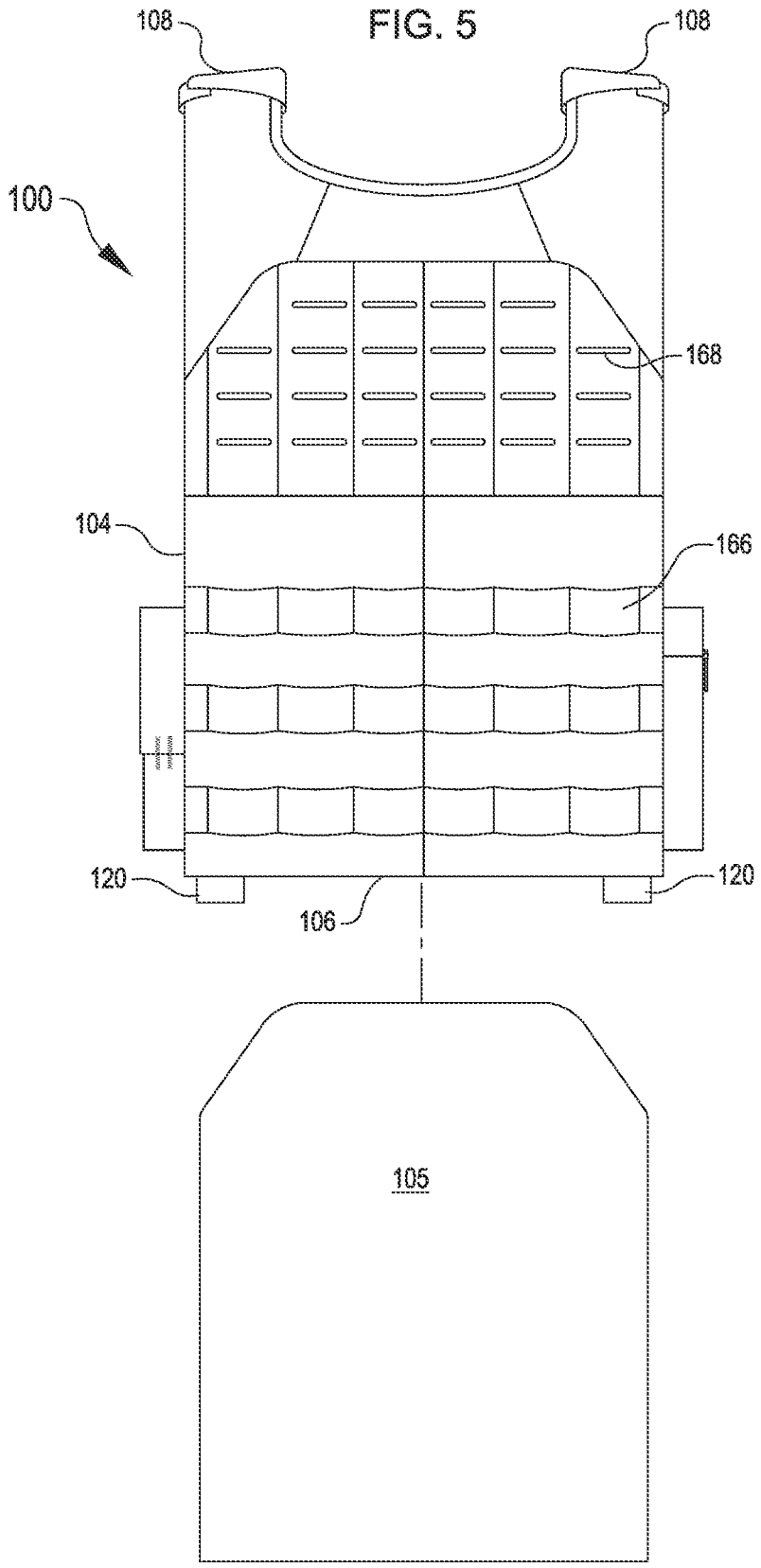
FIG. 5 shows a rear view of a weight-training vest according to some embodiments.

Referring now to the drawings, in which like reference numerals represent like parts throughout the several views, FIGS. 1 through 5 show a weight-training vest 100. Generally, FIGS. 1 and 2 show different front perspective views from opposite sides (e.g., from left and right), FIGS. 3 and 4 show detail side views, and FIG. 5 shows a rear view.

The weight-training vest 100 can include a front panel 102 (e.g., FIG. 1 and FIG. 2) and a rear panel 104 (e.g., FIG. 5). The front panel 102 can include a front weight pocket for receiving a front weight insert 103. Similarly, the rear panel 104 can include a rear weight pocket for receiving a rear weight insert 105. For example, the front panel 102 and/or the rear panel 104 along a bottom edge or other suitable position can have a suitable juncture 106 along which layers can be separably coupled (such as by hook and loop fasteners or other suitable closures) or otherwise capable of permitting access into a weight pocket therein. The front weight insert 103 and/or the rear weight insert 105 may correspond to weighted plates, bags, or any other form factor of weighted insert. The front weight insert 103 and/or the rear weight insert 105 may be retained within the respective weight pockets by any suitable structure. Examples may include, but are not limited to, those described in U.S. Pat. No. 9,993,039, entitled "GARMENT WITH PLATE CARRYING SYSTEM," issued Jun. 12, 2018, and U.S. Non-Provisional patent application Ser. No. 16/203,382, entitled "PLATE CARRIER ABSORPTION OF SHOCK FROM MOVEMENT OF WEARER," filed Nov. 28, 2018 (also published as U.S. Patent Application Publication No. 2020/0166313, published on May 28, 2020), the entire disclosures of which are hereby incorporated herein by reference. In use, the weight-training vest 100 may be provided as a weight training assembly with or without the front weight insert 103 and/or the rear weight insert 105.

The front panel 102 and the rear panel 104 may be arranged, respectively, along the front and rear of the torso of a wearer in use. For example, the front panel 102 and the rear panel 104 may be attached by a shoulder yoke 108 or any other suitable arrangement of straps or members that extend over one or more shoulders of the wearer in use to connect the front panel 102 with the rear panel 104 and support the front panel 102 and the rear panel 104 relative to the user's torso.

The weight-training vest 100 can include a cummerbund 110. In use, the cummerbund 110 may extend at least partially around the wearer's torso to retain or hold in place parts of the weight-training vest 100 relative to the torso of the wearer. The cummerbund 110 may attach the front panel 102 and the rear panel 104 to one another, e.g., along sides of the wearer's torso.

The cummerbund 110 can include multiple parts (which may be noncontiguous). For example, the cummerbund 110 can include a first lateral cummerbund segment 112 (e.g., FIG. 1) and a second lateral cummerbund segment 114 (e.g., FIG. 2). In use, the first lateral cummerbund segment 112 may be arranged along a first lateral side of the wearer's torso (e.g., one of the left side or the right side), and the second lateral cummerbund segment 114 may be arranged along a second lateral side of the wearer's torso (e.g., the other of the left side or the right side).

The cummerbund 110 may be adjustable in length to accommodate different girths of torso in use. Respective ends of the cummerbund 110 and/or segments thereof may be captured within or along the front panel 102 and/or the rear panel 104 by variable amounts, which may be adjusted to change how much of the cummerbund 110 instead extends between the front panel 102 and rear panel 104. The weight-training vest 100 may include features to facilitate such adjustability. As an illustrative example, the front panel 102 in FIG. 1 is shown with a mounting panel 116 and a flap panel 118. The front end of the first lateral cummerbund segment 112 may be captured within or between the flap panel 118 and the mounting panel 116. If adjustment is desired, the flap panel 118 can be lifted (e.g., such as by pulling on pulltabs 120 or otherwise separating the parts), the front end of the first lateral cummerbund segment 112 may be shifted (e.g., outwardly to enlarge or inwardly to contract so that the size of cummerbund 110 changes to accommodate a different girth), and the flap panel 118 can be lowered and reengaged with the mounting panel 116 to capture the front end of the first lateral cummerbund segment 112 in the newly accommodated position. Similar adjustment may be available at the rear panel and/or with the second lateral cummerbund segment 114. Overall, the weight-training vest 100 can be adjusted by the flap panel 118 (or by any other suitable structure if present instead or additionally) to accommodate different torso sizes of different wearers and/or may be reconfigurable to customize among differing extents or degrees of snugness according to the preference of the specific wearer.

The cummerbund 110 may include a lapped-band pocket 122. For example, the lapped-band pocket 122 is shown in FIG. 1 as forming a portion of the first lateral cummerbund segment 112. In addition to the portion formed by the lapped-band pocket 122, the first lateral cummerbund segment 112 may include anchor portions (e.g., which are not visible in FIG. 1 on account of being captured beneath the flap panel 118).

The lapped-band pocket 122 may be configured to be arranged along a first lateral side of the wearer's torso in use. For example, this may correspond to the left side or the right side of the wearer.

The lapped-band pocket 122 can include various layers and/or parts. In FIG. 1, the lapped-band pocket 122 is shown with a backing substrate 124, a base substrate 126, and a cover substrate 128. The base substrate 126 may extend over and/or be spaced outwardly from a lower surface of the backing substrate 124, and the cover substrate 128 may extend over and/or be spaced outwardly from an upper surface of the backing substrate 126, for example. Parts may be formed with suitable form factors. The base substrate 126 may form an upper band, and the cover substrate 128 may form a lower band. The upper and lower bands may be at least partially lapped over one another, for example. Parts or subcomponents of the lapped-band pocket 122 may be arranged so that when the weight-training vest 100 is worn, the backing substrate 124 (e.g., along an exterior) faces towards the wearer's torso, while the base substrate 126 and the cover substrate 128 (e.g., along exteriors) face away from the wearer's torso.

Parts or subcomponents of the lapped-band pocket 122 may define an interior volume of the lapped-band pocket 122. For example, the interior volume of the lapped-band pocket 122 may be bounded among the backing substrate 124, the base substrate 126, and the cover substrate 128.

The lapped-band pocket 122 can be formed by any suitable connection among the backing substrate 124, the base substrate 126, and the cover substrate 128. The respective parts may be stitched, bonded, or otherwise attached together in any other suitable manner to one another, such as along edges to define the interior volume of the lapped-band pocket 122. In some embodiments, parts may be integrally formed together, such as being formed by a single piece that is folded in order to define the respective elements described. For example, material may be folded or doubled over to form a transition from the backing substrate 124 to the base substrate 126 and/or the cover substrate 128 along top, bottom, or other edges. Transitioning at a fold or doubled over interface may allow savings such as a reduction in labor for production and/or may facilitate stretching (e.g., avoiding seams or other joining structures that could otherwise limit stretch, such as described further below).

As may best be seen by way of example in FIG. 4, the base substrate 126 may include an upper edge 130. An upper rim 132 may be arranged along the upper edge 130.

The cover substrate 128 may have a lower edge 134. A lower rim 136 may be arranged along the lower edge 134.

The lower rim 136 can be imbricated or lapped over the upper rim 132. A substantial portion of the lapped-band pocket 122 where the upper rim 132 and lower rim 136 overlap can define a passage 138 that can provide access to the interior volume of the lapped-band pocket 122. In use, the lower rim 136 and the upper rim 132 may remain substantially overlapped when not manipulated by a user and thus provide a covered interface at the opening or passage 138 without being releasably attached at the interface.

Parts of the lapped-band pocket 122 may be arranged facilitate access via the passage 138 and/or to block access apart from the passage 138. For example, the backing substrate 124 may function as a barrier to prevent exit of items from the interior volume toward the wearer's torso. The base substrate 126 may function as a lower retaining wall or band to prevent exit of items along a lower side of the interior volume in a direction away from the wearer's torso. The cover substrate 128 may function as an upper obstruction or band to block exit of items along an upper side of the interior volume in a direction away from the wearer's torso.

Although various parts of the lapped-band pocket 122 may block access, the interior volume may be accessible from outside the lapped-band pocket 122 by reaching through the passage 138. For example, a user may reach toward the passage 138 and gain access to the interior volume of the lapped-band pocket 122 by a sequence of motions relative to the base substrate 126 and the cover substrate 128.

The sequence may include moving the user's hand outside of the base substrate 126 (as at arrow 140) and passing between the upper rim 132 of the base substrate 126 and the lower rim 136 of the cover substrate (e.g., as at arrow 142). For example, passing between the upper rim 132 and the lower rim 136 may include passing in front of the lower rim 136 and behind the upper rim 132. The sequence may continue with reaching over the top of the upper rim 132 and upper edge 130 while still behind the cover substrate 128 (as at arrow 144). The sequence may conclude with moving behind the upper rim 132 of the base substrate 126 (as at arrow 146).

Generally, the lapped-band pocket 122 may act as a quick access pocket that a user can quickly and easily reach into without operating a fastener, fixture, or closure. The passage 138 may be maintained open or accessible and work without a closure, fixture and/or fastener. For example, the passage 138 may be configured as a fastener-less passage. Access provided by the lapped-band pocket 122 may be suitable for athletic training where ready access may be desirable for a towel or other item in a quick access manner before, after, or during a workout, and where there is minimal risk of important gear falling out as may be a concern in a tactical situation, for example.

The lapped-band pocket 122 may be formed such that the backing substrate 124 is larger in height or taller than each of the base substrate 126 and the cover substrate 128. For example, the base substrate 126 may extend from a lower edge of the backing substrate 124 and may extend less than a full height upward from that position. The cover substrate 128 may also be a smaller or shorter component than the backing substrate 124 and may have a height that is less than a height of the backing substrate 124. For example, the cover substrate 128 may extend from an upper edge of the backing substrate 124 and may extend less than a full height downward from that position. The height of the base substrate 126 and the height of the cover substrate 128 in combination or sum may be greater than a height of the backing substrate 124. For example, this may cause the overlapping of the upper rim 132 and the lower rim 136 to define the passage 138 for access into the interior of the lapped-band pocket 122.

The upper rim 132 and the lower rim 136 can be attached to one another along one or more portions thereof. For example, stitching 148 is shown in FIG. 4 adjacent the front panel 102 and the rear panel 104. Although the stitching 148 is depicted as a pair of bartack stitches at each side of the passage 138, the stitching 148 may be supplemented and/or replaced with more or fewer stitches, non-bartack stitch types, differing numbers of stitches at opposite ends, and/or any other suitable form of joining the portions of the upper rim 132 and the lower rim 136. Attachment of portions of the upper rim 132 and the lower rim 136 may cause the passage 138 to extend less than an entire length of the lapped-band pocket 122. The passage 138 extending less than the entire length may allow items within the lapped-band pocket 122 to more securely retain items than if the passage 138 extended the entire length.

The weight-training vest 100 can additionally or alternatively include a zippered pocket 150. For example, the zippered pocket 150 is shown in FIG. 2 as forming a portion of the second lateral cummerbund segment 114. As illustrated in FIG. 2, in use, the zippered pocket 150 may be configured to be arranged along the second lateral side of the wearer's torso. However, in some embodiments, the zippered pocket 150 may additionally or alternatively be arranged along a first lateral side of the wearer's torso. For example, the weight-training vest 100 may be provided with the zippered pocket 150 and the lapped-band pocket 122 on opposite sides than those shown in FIGS. 1 and 2 and/or may be provided with zippered pockets 150 on both sides of the weight-training vest 100 and/or lapped-band pockets 122 on both sides of the weight-training vest 100.

As may be best seen in FIG. 2, the zippered pocket 150 may include or be formed from an inward face substrate 152 and an outward face substrate 154. The outward face substrate 154 may extend over and/or be spaced outwardly from a surface of the inward face substrate 152, for example. The inward face substrate 152 (e.g., along an exterior) may face toward the wearer's torso in use. The outward face substrate 154 (e.g., along an exterior) may face away from the wearer's torso in use.

Parts or subcomponents of the zippered pocket 150 may define an internal volume of the zippered pocket 150. For example, the internal volume may be bounded among the inward face substrate 152 and the outward face substrate 154.

The zippered pocket 150 can be formed by any suitable connection among the inward face substrate 152 and the outward face substrate 154. The respective parts may be stitched, bonded, or otherwise attached together in any other suitable manner to one another, such as along edges to define the internal volume of the zippered pocket 150. In some embodiments, parts may be integrally formed together, such as being formed by a single piece that is folded in order to define the respective elements described. For example, material may be folded or doubled over to form a transition between the inward face substrate 152 and the outward face substrate 154 along top, bottom, or other edges. Transitioning at a fold or doubled over interface may allow savings such as a reduction in labor for production and/or may facilitate stretching (e.g., avoiding seams or other joining structures that could otherwise limit stretch, such as described further below).

The zippered pocket 150 can include a zipper 156. For example, the zipper 156 may include a set of mating teeth that can be brought into or out of engagement with one another in response to movement of a slider. The slider may be manipulable by pulling on a pull tab 158 coupled with the slider, for example.

The zipper 156 may be arranged on the outward face substrate 154. The zipper 156 can be operable for opening to unblock an aperture that permits access into the internal volume of the zippered pocket 150 from outside of the zippered pocket 150. The zipper 156 additionally may be operable for closing to block the aperture into the internal volume of the zippered pocket 150.

In use, the zippered pocket 150 may be useful in an athletic training situation for a closure option that may be easily operated to contain or enclose loose contents, e.g., which may be desirable to be more secure than in the lapped-band pocket 122. For example, the zippered pocket 150 may provide a secure closure for enclosing or encapsulating a pocket interior that may hold a phone or other electronic device, headphones, snacks, keys, or other nebulous or discrete items that may be readily accessed by operating the zipper at ease between reps or before or after a workout. The zipper 156 may be better suited for athletic training situations in comparison to tactical situations. For example, in tactical situations where environments may be more varied and less controlled than in athletic-training situations, zippers may be prone to jam due to exposure to sand or other environmental factors. In addition, in tactical situations, access to pocket contents may need to be faster than zippers may afford (especially if potentially-jammed from environmental factors). Further, in tactical situations, space may be insufficient on account of side cummerbund potentially being occupied by attachment capability such as MOLLE or multiple storage pouches to accommodate specific gear needed for tactical operations such as a magazine, radio, etc. Also, in tactical situations, zippers may risk snagging or otherwise interfering with straps or other features of rucksacks, weapons, or other gear that may be present in a tactical scenario but that is unlikely to be present in an athletic-training scenario. Moreover, in tactical situations where ballistic plates are to be introduced into pouches, zippers may be desirable to avoid, e.g., based on a possible propensity for plates to slide easily and not remain in a predetermined location behind a zipper and/or a potential difficulty in inserting a plate through a zipper opening that may be smaller than an entire length or other dimension of a pouch or corresponding plate.

In some embodiments, at least some portion of the material of the zippered pocket 150 may partially bunch or otherwise overlap (e.g., forming a guard, flap, cover, or shroud) over at least an edge portion of the zipper 156 in an at rest state. This may reduce a chance of the zipper 156 catching on or otherwise interfering with other items in use, for example.

The zippered pocket 150 and/or the lapped-band pocket 122 may be formed of suitable materials. For example, the respective substrates within the zippered pocket 150 and/or the lapped-band pocket 122 may be formed of any suitable construction of one or more layers.

The zippered pocket 150 and/or the lapped-band pocket 122 may form substantially an entirety of a corresponding subsection of the cummerbund 110. For example, the cummerbund 110 may extend from either end and/or be formed without other backing or panels in the segment in which the respective pockets are arranged.

In some embodiments, material used may allow the zippered pocket 150, the lapped-band pocket 122, and/or other portion of the cummerbund 110 to be more stretchable than the front panel 102 or the rear panel 104. Stretchable material used may exhibit a degree of stretch in which the material can stretch from an unloaded length to a loaded length without undergoing plastic deformation or damage. The stretchable material may exhibit an elastic response or resilience that may cause the material to return to an unstretched length in response to cessation of load. In some embodiments, the material used may include stretch woven fabric.

In some embodiments, stretchable material may be incorporated such that all or a part of the cummerbund 110 (such as the zippered pocket 150 and/or the lapped-band pocket 122 and/or other portion) may stretch to be a certain percentage of its original size. By way of illustration, in FIG. 3, the zippered pocket 150 is demarcated with an original or unstretched length LZ, and in FIG. 4, the lapped-band pocket 122 is demarcated with an original or unstretched length LL. As an illustrative example, the material may be sufficiently stretchable to allow reaching to 150% of the unstretched length LZ and/or LL. In some examples, the degree of stretch may be greater or less, with further examples including stretching to reach 110%, 120%, 130%, 140%, 150%, 160%, 170%, 180%, 190%, 200% or more relative to LZ, LL, or other original size. The zippered pocket 150 and/or the lapped-band pocket 122 may be stretchable by different or equal amounts relative to one another. Overall, in use, the stretching of the zippered pocket 150 and/or the lapped-band pocket 122 may allow the cummerbund 110 to conform to a torso of a user notwithstanding shifts and movements of the user, such as may occur with frequency in athletic training. Additionally or alternatively, the stretching of the lapped-band pocket 122 may maintain the upper rim 132 and the lower rim 136 in overlapping engagement to retain items within the lapped-band pocket 122. For example, the stretchability may lend a tautness to the lapped-band pocket 122 that may resist movement of retained items through the passage 138.

In some embodiments, a form factor utilized for one or more of the pockets may facilitate stretch. For example, transitions along upper and/or lower edges may include transitioning at a fold or doubled over interface, which may avoid seams or other joining structures that could otherwise limit stretch. In some embodiments, the stretchable material resembles a tube without seams along both upper and lower edges and with open ends of the tube closed by stitching or other suitable joining to encapsulate a volume within for the pocket, for example. A tubular structure may facilitate stretching along a length of the tube and avoid joining structures that may limit such stretching along the tube length.

Although the weight-training vest 100 may be particularly suited for athletic training situations, the weight-training vest 100 may include tactically-relevant features and/or features that provide an appearance, "look," or aesthetic resembling or related to a tactical situation, e.g., as may be desired by many individuals in weight-training situations. As one illustrative example, the weight-training vest 100 in the figures is shown with an admin pocket 162 (e.g., FIG. 1), which may correspond to a pocket that may be readily accessible (e.g., accessible in a vertically downward direction) and/or otherwise suitably shaped and/or sized for receiving a notebook or other similarly sized items. As an additional illustrative example, the weight-training vest 100 in the figures is shown with hook and loop fastener areas 164 (e.g., FIG. 1), which may be utilized for releasably attaching elements such as patches for insignias, other identifying information, and/or other purposes. As a further illustrative example, the weight-training vest 100 in the figures is shown with various types of attachment platforms, which may be selected from options such as MOLLE-compatible loops 166 (e.g., FIG. 1 and/or FIG. 5), laser-cut or otherwise-formed MOLLE-compatible slits 168 (e.g., FIG. 5), and/or any other suitable structures for gear-attachment systems (including, but not limited to those described in U.S. Pat. No. 10,070,714, entitled "HEXAGONAL ATTACHMENT SYSTEM," issued Sep. 11, 2018, the entire disclosures of which are hereby incorporated herein by reference).

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A weight-training vest assembly, comprising:

a front panel including a front weight pocket for receiving a front weight insert;

a rear panel including a rear weight pocket for receiving a rear weight insert, the front panel and the rear panel configured for being arranged respectively along a front and a rear of a torso of a wearer when the weight-training vest assembly is worn by the wearer;

a lapped-band pocket configured to be arranged along a first lateral side of the wearer's torso, the lapped-band pocket forming a portion of a first lateral cummerbund segment configured to connect the front panel with the rear panel, the lapped-band pocket comprising:

a backing substrate configured to face toward the wearer's torso;

a base substrate spaced outwardly from a lower surface of the backing substrate and forming a lower band configured to face away from the wearer's torso, the base substrate having an upper edge along a top thereof and an upper rim arranged along the upper edge;

a cover substrate spaced outwardly from an upper surface of the backing substrate and forming an upper band configured to face away from the wearer's torso, the cover substrate having a lower edge along a bottom thereof and a lower rim arranged along the lower edge, the lower rim of the cover substrate lapped over the upper rim of the base substrate; and an interior volume bounded among the backing substrate, the base substrate, and the cover substrate, wherein the interior volume is accessible from outside the lapped-band pocket by reaching through a fastener-less passage defined between the lower rim of the cover substrate and the upper rim of the base substrate; and a zippered pocket configured to be arranged along a second lateral side of the wearer's torso, the zippered pocket forming a portion of a second lateral cummerbund segment configured to connect the front panel with the rear panel, the zippered pocket comprising:

an inward face substrate configured to face toward the wearer's torso;

an outward face substrate spaced outwardly from a surface of the inward face substrate and configured to face away from the wearer's torso;

an internal volume bounded among the inward face substrate and the outward face substrate; and a zipper arranged on the outward face substrate, the zipper operable for opening to unblock an aperture that permits access into the internal volume from outside the zippered pocket, and the zipper further operable for closing to block the aperture into the internal volume.

2. The weight-training vest assembly of claim 1, further comprising at least one of:

the front weight insert; or the rear weight insert.

3. The weight-training vest assembly of claim 1, wherein the backing substrate, the base substrate, and the cover substrate of the lapped-band pocket are integrally formed together; and wherein the inward face substrate and the outward face substrate of the zippered pocket are integrally formed together.

4. The weight-training vest assembly of claim 1, wherein the lapped-band pocket and the zippered pocket are each formed of material that is more stretchable than the front panel and the rear panel.

5. The weight-training vest assembly of claim 4, wherein the material comprises stretch woven fabric.

6. The weight-training vest assembly of claim 1, wherein the first lateral cummerbund segment and the second lateral cummerbund segment are each at least partially captured within the front panel and the rear panel.

7. The weight-training vest assembly of claim 1, further comprising an attachment platform coupled with at least one of the front panel or the rear panel and comprising at least one of a loop or a slit.

8. A weight-training vest assembly, comprising:

a lapped-band pocket forming a portion of a lateral cummerbund segment and configured to be arranged along a lateral side of a wearer's torso, the lapped-band pocket comprising:

a backing substrate configured to face toward the wearer's torso;

a base substrate spaced outwardly from a lower surface of the backing substrate and forming a lower band configured to face away from the wearer's torso, the base substrate having an upper edge and an upper rim arranged along the upper edge;

a cover substrate spaced outwardly from an upper surface of the backing substrate and forming an upper band configured to face away from the wearer's torso, the cover substrate having a lower edge and a lower rim arranged along the lower edge, the lower rim of the cover substrate lapped over the upper rim of the base substrate; and an interior volume bounded among the backing substrate, the base substrate, and the cover substrate, wherein the interior volume is accessible from outside the lapped-band pocket by reaching through a passage defined between the lower rim of the cover substrate and the upper rim of the base substrate.

9. The weight-training vest assembly of claim 8, wherein the passage into the lapped-band pocket is bounded at least at one end by stitching through the upper rim and the lower rim.

10. The weight-training vest assembly of claim 8, wherein the passage into the lapped-band pocket is free of closures and fasteners.

11. The weight-training vest assembly of claim 8, wherein the backing substrate is taller than each of the base substrate and the cover substrate individually, and wherein a sum of heights of the base substrate and the cover substrate is greater than a height of the backing substrate.

12. The weight-training vest assembly of claim 8, wherein the lower rim of the cover substrate being lapped over the upper rim of the base substrate allows access into the interior volume of the lapped-band pocket by a sequence of motions that includes:

moving outside of the base substrate;

passing between the upper rim of the base substrate and the lower rim of the cover substrate;

moving over a top of the upper rim while behind the cover substrate; and moving behind the upper rim of the base substrate.

13. The weight-training vest assembly of claim 8, wherein the lapped-band pocket is formed of material that is more stretchable than a front panel and a rear panel of the weight-training vest assembly.

14. The weight-training vest assembly of claim 8, wherein the lapped-band pocket is stretchable to 130% of an unstretched length of the lapped-band pocket.

15. The weight-training vest assembly of claim 8, wherein the lateral side is a first lateral side of the wearer's torso, wherein the lateral cummerbund segment is a first lateral cummerbund segment, and wherein the weight-training vest assembly further comprises:

a front panel;

a rear panel, the front panel and the rear panel configured for being arranged respectively along a front and a rear of the wearer's torso when worn by the wearer;

a zippered pocket configured to be arranged along a second lateral side of the wearer's torso, the zippered pocket forming a portion of a second lateral cummerbund segment configured to connect the front panel with the rear panel, the zippered pocket comprising:

an inward face substrate configured to face toward the wearer's torso;

an outward face substrate spaced outwardly from a surface of the inward face substrate and configured to face away from the wearer's torso;

an internal volume bounded among the inward face substrate and the outward face substrate; and a zipper arranged on the outward face substrate, the zipper operable for opening to unblock an aperture that permits access into the internal volume from outside the zippered pocket, and the zipper further operable for closing to block the aperture into the internal volume.

16. A weight-training vest assembly, comprising:

a zippered pocket forming a portion of a lateral cummerbund segment and configured to be arranged along a lateral side of a wearer's torso, the zippered pocket comprising:

an inward face substrate configured to face toward the wearer's torso;

an outward face substrate spaced outwardly from a surface of the inward face substrate and configured to face away from the wearer's torso;

an internal volume bounded among the inward face substrate and the outward face substrate; and a zipper arranged on the outward face substrate, the zipper operable for opening to unblock an aperture that permits access into the internal volume from outside the zippered pocket, and the zipper further operable for closing to block the aperture into the internal volume.

17. The weight-training vest assembly of claim 16, wherein the zippered pocket is formed of material that is more stretchable than a front panel and a rear panel of the weight-training vest assembly.

18. The weight-training vest assembly of claim 16, wherein the zippered pocket is stretchable to 110% of an unstretched length of the zippered pocket.

19. The weight-training vest assembly of claim 16, wherein the inward face substrate transitions to the outward face substrate of the zippered pocket at a doubled over fold of material at an edge of the zippered pocket.

20. The weight-training vest assembly of claim 16, wherein the lateral side is a second lateral side of the wearer's torso, wherein the lateral cummerbund segment is a second lateral cummerbund segment, and wherein the weight-training vest assembly further comprises:

a front panel;

a rear panel, the front panel and the rear panel configured for being arranged respectively along a front and a rear of the wearer's torso when worn by the wearer;

a lapped-band pocket configured to be arranged along a first lateral side of the wearer's torso, the lapped-band pocket forming a portion of a first lateral cummerbund segment configured to connect the front panel with the rear panel, the lapped-band pocket comprising:

a backing substrate configured to face toward the wearer's torso;

a base substrate spaced outwardly from a lower surface of the backing substrate and forming a lower band configured to face away from the wearer's torso, the base substrate having an upper edge and an upper rim arranged along the upper edge;

a cover substrate spaced outwardly from an upper surface of the backing substrate and forming an upper band configured to face away from the wearer's torso, the cover substrate having a lower edge and a lower rim arranged along the lower edge, the lower rim of the cover substrate lapped over the upper rim of the base substrate; and an interior volume bounded among the backing substrate, the base substrate, and the cover substrate, wherein the interior volume is accessible from outside the lapped-band pocket by reaching through a passage defined between the lower rim of the cover substrate and the upper rim of the base substrate.

* * * * *